US005765714A

United States Patent [19]

Nakano et al.

[11] Patent Number: 5,765,714

[45] Date of Patent: Jun. 16, 1998

[54] LID MOUNTING STRUCTURE FOR PRESSURE VESSEL

[75] Inventors: Takashi Nakano, Kyoto; Satoshi Mekata, Ibaraki; Tamao Okabayashi, Takatsuki, all of Japan

[73] Assignee: Osaka Shipbuilding Co., Ltd., Osaka-fu, Japan

[21] Appl. No.: 817,348

[22] PCT Filed: Aug. 10, 1995

[86] PCT No.: PCT/JP95/01612

§ 371 Date: Apr. 9, 1997

§ 102(e) Date: Apr. 9, 1997

[87] PCT Pub. No.: WO97/06078

PCT Pub. Date: Feb. 20, 1997

[51] Int. Cl.[6] ..... B65D 6/00

[52] U.S. Cl. ..... 220/619; 220/614

[58] Field of Search ..... 220/619, 614, 220/620, 681, 689

[56] References Cited

U.S. PATENT DOCUMENTS

| | | | |
|---|---|---|---|
| 2,643,914 | 6/1953 | Reswick | 220/619 |
| 3,367,533 | 2/1968 | Baker | 220/619 |
| 3,550,832 | 12/1970 | Fitzgerald | 220/619 |
| 4,597,502 | 7/1986 | Troughton | 200/619 |
| 4,813,576 | 3/1989 | Greenebaum, II | 220/619 |
| 5,178,297 | 1/1993 | Harold | 220/619 |

FOREIGN PATENT DOCUMENTS

| | | |
|---|---|---|
| 41-11238 | 6/1966 | Japan . |
| 51-25610 | 8/1976 | Japan . |
| 62-115391 | 6/1987 | Japan . |
| 5-85431 | 12/1993 | Japan . |
| 7-149382 | 6/1995 | Japan . |

*Primary Examiner*—Joseph M. Moy
*Attorney, Agent, or Firm*—McDermott, Will & Emery

[57] ABSTRACT

A lid mounting structure for a pressure vessel for preventing a lid member 2 crimped to a curled portion 6 of an opening 5 of a vessel body 1 from being blown away by an abnormal rise of the internal pressure. A cut-away portion 8 or a through hole is formed in an outside wall of the curled portion 6, thereby locally reducing the elastic deformation resisting strength of the curled portion 6 with respect to expansion of the inside diameter of the opening to a level lower than that of the elastic deformation resisting strength of the lid member 2 in the inward radial direction.

15 Claims, 10 Drawing Sheets

LID MOUNTING STRUCTURE FOR PRESSURE VESSEL

TECHNICAL FIELD

The present invention relates to a lid mounting structure for a pressure vessel, and more particularly, to a lid mounting structure capable of preventing a lid of a pressure vessel, such as an aerosol container, from being blown away by an abnormal rise of the internal pressure.

BACKGROUND ART

A general type of aerosol dispensing container has an opening at an upper end of a dome mounted on a body or an upper end of a shoulder portion formed with the body, and a valve is mounted on the opening. The valve is attached to the body by forming a curled portion directing out side at a periphery of the opening, capping a mounting cap with a valve on the curled portion with sandwiching a gasket between the curled portion and the mounting cap, and crimping or clinching a side wall of the mounting cap to the under side of the curled portion.

When such a aerosol container is left in a high temperature atmosphere such as in an automobile in summer, the internal pressure rises abnormally. Then, the container body tends to accidentally break at a seam or the like, or the mounting cap is accidentally blown away from the vessel body. Further, when the container is thrown into an incinerator without letting the internal gas out, a similar accident may happen.

In order to prevent such accident, there has been hitherto proposed such an aerosol container having a body with a through hole and a plug tightly inserted in the hole. The plug is made of a metal with low fusing point, so that the plug will fuse under high temperature to let the internal gas escape (see Japanese Examined Patent Publication No. 25610/1976). Further, it can be considered to provide a pressure relieve valve to a bottom of the container body.

The former is effective when the container is thrown into an incinerator. However, since the plug does not fuse at the temperature in an automobile, 70° to 80° C. for example, the valve cannot be prevented from being blown away. As the latter case, the relieving pressure can be freely set up, and the container can use continuously after the internal gas escapes. However, such aerosol container is high in cost, and does not be used for practical use.

On the other hand, there is known such type of aerosol device that has a container body made of synthetic resin or glass, and a cap-like mounting cap capped on an opening of the body, in which a lower end of the cap is engaged and fixed to a flange formed at the rim of the opening of the container. In such type of the aerosol device, there was proposed a device capable of preventing from explosion by changing strength of the mounting cap and forming a gas-escaping-hole (see Japanese Examined Patent Publication No.85431/1993). However, the device can be applied to only an aerosol device having a specific type of mounting cap.

An object of the present invention is to delete the problem that a lid is blown away in a pressure vessel in which a specific lid member such as a known mounting cap or the like is used. That is to say, an object of the present invention is to provide a lid mounting structure for a pressure vessel which can prevent a lid member from being blown away by a rise of the internal pressure, further by which the pressure vessel can be continuously used after the inner pressure falls down, and which can be manufactured with low cost.

The inventors have performed much reappearance tests of the blowout accident of an aerosol container. Further, various devices including the above-mentioned propositions were tested under various conditions. However, any mechanism which perfectly functions cannot be obtained. That is to say, even if a prototype or trial model was able to prevent a lid from being blown away, blowout accidents had happen at a rate when many containers were really manufactured and tested as a production test.

The inventors thought that the failure of those mechanisms was caused by fall of reliability of the container due to addition of various structures to the existing aerosol container. And the inventors considered that partial change in the existing manufacturing process of the container would rather provide good result. Then, the present invention was completed.

DISCLOSURE OF THE INVENTION

According to the present invention, there is provided a lid mounting structure for a pressure vessel, the structure comprising a body provided with a curled portion curling outward at periphery of an opening and a lid member to be fixed on the opening of the body. The lid member has a ring-like capping portion having an inverse-U shape in cross section so as to be capped around the curled portion, a side wall extending downward from an inner and lower end of the capping portion so as to be received with an inner circumferential face of the curled portion, and a bottom extending inwardly from a lower end of the side wall. The lid member is to be fixed to the opening of the body by projecting lower portions of the side wall outward in radial directions to be crimped with under face of the curled portion. Further, a seal structure constructed with the curled portion, a gasket and the capping portion is not uniform with respect to circumferential direction such that at least one of the curled portion, the gasket and the capping portion causes elastic deformation to provide a local leak before the lid member causes plastic deformation and is blown away.

The above-mentioned seal structure can be obtained, for example, by locally reducing the elastic-deformation-resisting strength of the curled portion than the elastic-deformation-resisting strength of the side wall of the lid member. The elastic-deformation-resisting strength of the curled portion means a strength for resisting against elastic deformation of the curled portion in the curling direction which provides expansion of inside diameter thereof and which is caused by the internal pressure and the pressing force of the lid member. The elastic-deformation-resisting strength of the side wall of the lid member means a strength for resisting against shrinking inwardly in the radial direction of the side wall of the lid member which is caused by the internal pressure and reactive force of the curled portion.

A concrete structure for reducing the elastic-deformation-resisting strength of the curled portion than the elastic-deformation-resisting strength of the lid member locally, for example, can be obtained by forming plural cut-away portions or holes in the outside wall of the curled portion so as to be arranged radially. In this case, the plural cut-away portions or holes are preferably arranged at middle positions between crimped portions adjacent mutually. Further, the elastic-deformation-resisting strength of the curled portion can also be locally weakened than the elastic-deformation-resisting strength of the lid member by locally reducing the thickness of the inner curled side of the curled portion. On the other hand, the elastic-deformation-resisting strength of the curled portion might be locally weakened than the elastic-deformation-resisting strength of the lid member by weakening the pressing force directing inward in the radial direction which is generated in the lid member and making engagement deeper by extending the crimped portions to the same position as the center of curl of the curled portion, or beyond the center of the curl.

Further, it is preferable to bend the bottom of the lid member toward inside of the vessel or to provide reinforcing ribs radially so that buckling does not easily occur. Further, it is preferable to combine some structures mentioned above so that the elastic-deformation-resisting strength of the curled portion is locally weakened enough than the elastic-deformation-resisting force of the lid member as a total structure.

Another means for making the seal structure un-uniform in the circumferential direction is to form a through hole, cut-away portion (notched portion) or thin portion for leaking gas in the vessel in the capping portion of the lid member at an area to be in contact with the gasket tightly, or in the curled portion at an area to be in contact with the gasket tightly, or in a periphery of the gasket. Such through hole, cut-away portion and thin portion are preferably formed at plural positions arranged radially.

In the prior art structure, when the inner pressure rises, the lid member is pressed up strongly, and the lid member and the curled portion of the lid member which sandwich the gasket therebetween are elastically deformed. Therefore, the force pressing the gasket, that is a sealing pressure, is reduced. If the seal structure is uniform in the circumferential direction, the above-mentioned elastic deformation does not cause large deformation in the original shapes. And the gas does not leak until the inner pressure rises greatly. Further, when the seal structure is uniform, the local deformation-resisting strength is also uniform. Therefore, when a local force to engage with the lid member rises beyond an upper limit, the whole is disengaged to cause the blowout of the lid.

To the contrary, in the structure of the present invention, though enough seal pressure can be kept in a range of an ordinary inner pressure, a local seal pressure at a specialized portion becomes low specially when the inner pressure rises abnormally, since the seal structure is not uniform. Therefore, gas leak occurs from the portion. Further, even if the local seal pressure becomes low at the portion, seal pressure and engaging force in another portion are not changed. Consequently, the blowout of the lid does not occur.

In a seal structure where an elastic-deformation-resisting force for resisting against elastic deformation of the curled portion in the curling direction which provides expansion of inside diameter thereof and which is caused by the internal pressure and the pressing force is weakened locally than an elastic-deformation-resisting strength for resisting against shrinking of the side wall of the lid member inwardly with respect to radial direction which is caused by the internal pressure and the reaction force of the curled portion, the curled portion is pushed upward and tends to expand outward when the internal pressure rises. To the contrary, the lid member is compressed inwardly with respect to the radial direction. However, since the elastic-deformation-resisting strength of the curled portion is weaker than the elastic-deformation-resisting strength of the lid member, the curled portion expands outward with respect to the radial direction before the elastic deformation of the lid increases. Under the situation, the curled portion tends to be further curled since the outer surface is covered with the capping portion of the lid member. That is to say, the curled portion tends to be expanded in the inner diameter, but the outer diameter is restricted, and a hoop stress, i.e. tension in the circumferential direction, is generated. Therefore, the free end (the lower end) of the curled portion is further curled inwardly, and the diameter of the curl tends to be reduced. As a result, a gap is generated between the outer surface of the curled portion and the inner surface of the capping portion, or the contacting pressure or the sealing pressure is reduced, to say the least of it. Therefore, leak in seal occurs between them, and the gas in the vessel leaks to fall the internal pressure. As a result, the blowout of the lid member can be prevented.

Since the above-mentioned deformation of the curled portion is elastic deformation, the shape returns to an original shape when the internal pressure falls down. Seal function between the curled portion and the capping portion therefore recovers again. Therefore, the pressure vessel can be used again for predetermined use such as spray of aerosol for example.

When the elastic-deformation-resisting force is locally weakened by forming plural cut-away portions or holes in the curled portion so as to be arranged in the radial arrangement, the curled portion do not expand uniform. And specific portions such as the cut-away portions are more yieldable and the specific portions tend to expand outward greater than another portion. Therefore, the curled portion deforms into so called polygonal shape, and the internal gas leaks easily from the easily deformable portion. As a result, function to prevent the blowout of the lid member can be effectively performed. Beside, when the cut-away portions and the holes are formed at middle positions between the crimped positions, the crimped portions can be securely engaged with the curled portion, and gas-leak-function can be securely performed at the positions near the cut-away portions.

When the crimped portions are projected to or beyond the center of the curl of the curled portion, the force directing inside with respect to the radial direction generated in the lid member is locally reduced and the engagement of the crimped portions become locally deep. Therefore, the lid member tends not to be easily blown away.

Further, when the bottom of the lid member is bent toward the inside of the vessel, the lid member tends to expand outward with receiving the internal pressure. Therefore, the engagement between the crimped portions and the curled portion becomes more secure so that the lid member is not easily disengaged, and further, face buckling does not easily happen. Then safety is further increased. When the lid member is provided with reinforcing ribs extending from the side wall to the bottom in the radial direction, the face buckling does not easily occur.

When the internal pressure rises, the capping portion of the lid member and the curled portion of the vessel body deform elastically. Then the gasket between them is pressed outward, and is also elasticaly deformed so that the inner diameter is expanded and thickness increases. Therefore, in a seal structure in which a through hole, cut-away portion or thin portion is formed at periphery of the gasket for leaking gas in the vessel when the gasket is elastically expanded in diameter by rising the internal pressure, gas begins to leak through the through hole or the cut-away portion when the gasket is elastically expanded. Then, the internal pressure is reduced, and the lid member is prevented from being blown away. Further, in a structure in which the gasket has thin portion in local area, the inner diameter expanded especially at the thin portion. Therefore, gas leaks through the portions, and internal pressure is reduced. Hereinafter, referring to the attached drawings, preferred embodiments of the lid mounting structure will be explained.

BEST MODE FOR CARRYING OUT THE INVENTION

Hereinafter, the structure of the present invention applied to aerosol vessels as typical embodiments will be explained. However, the present invention is not limited to those embodiments, and can be applied to lid mounting structures for any type of pressure vessels, and the same effect can be obtained.

Figure 1:
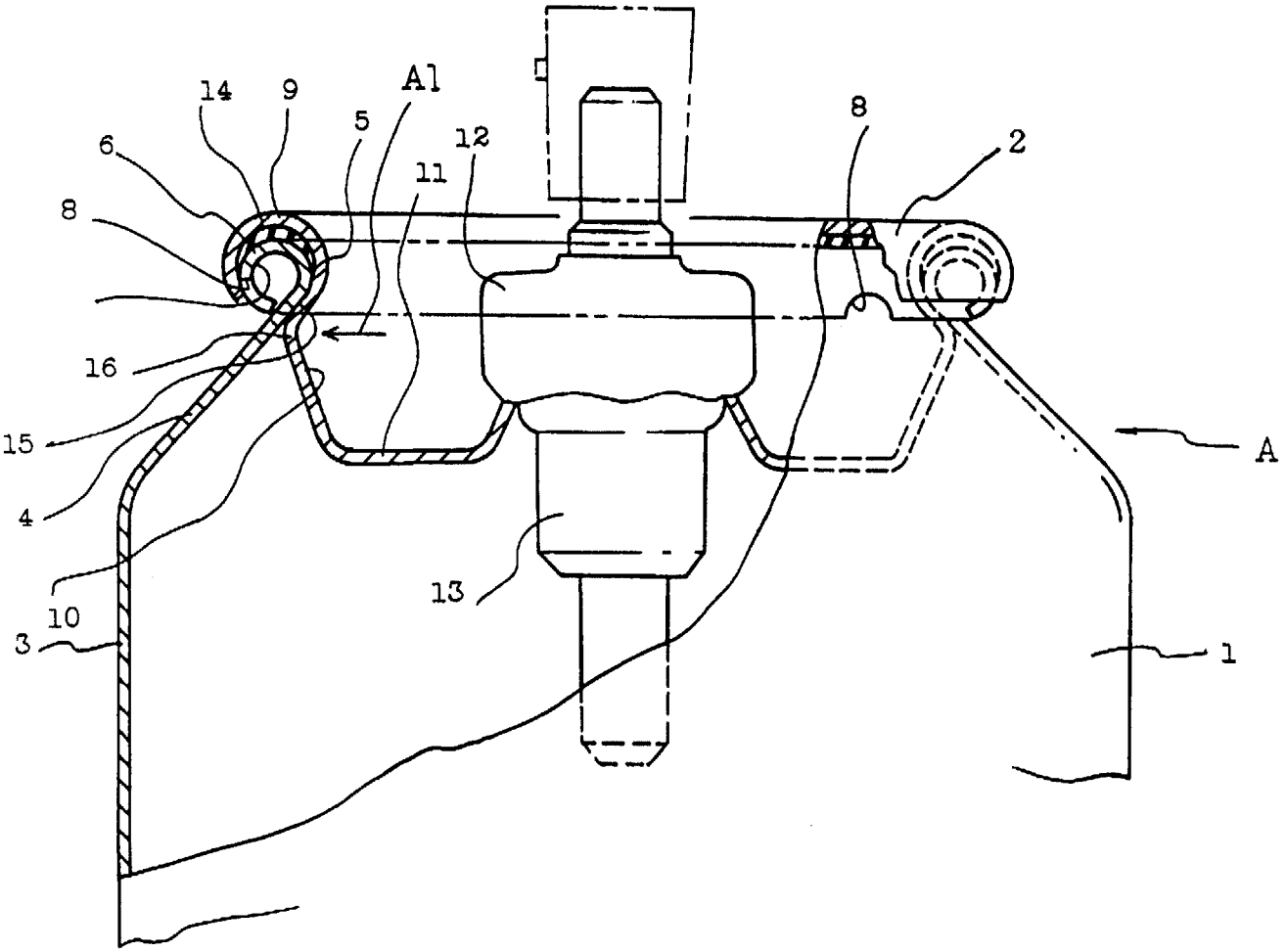
FIG. 1 is a partially cut-away front view showing an embodiment of the structure of the present invention.
Figure 2:
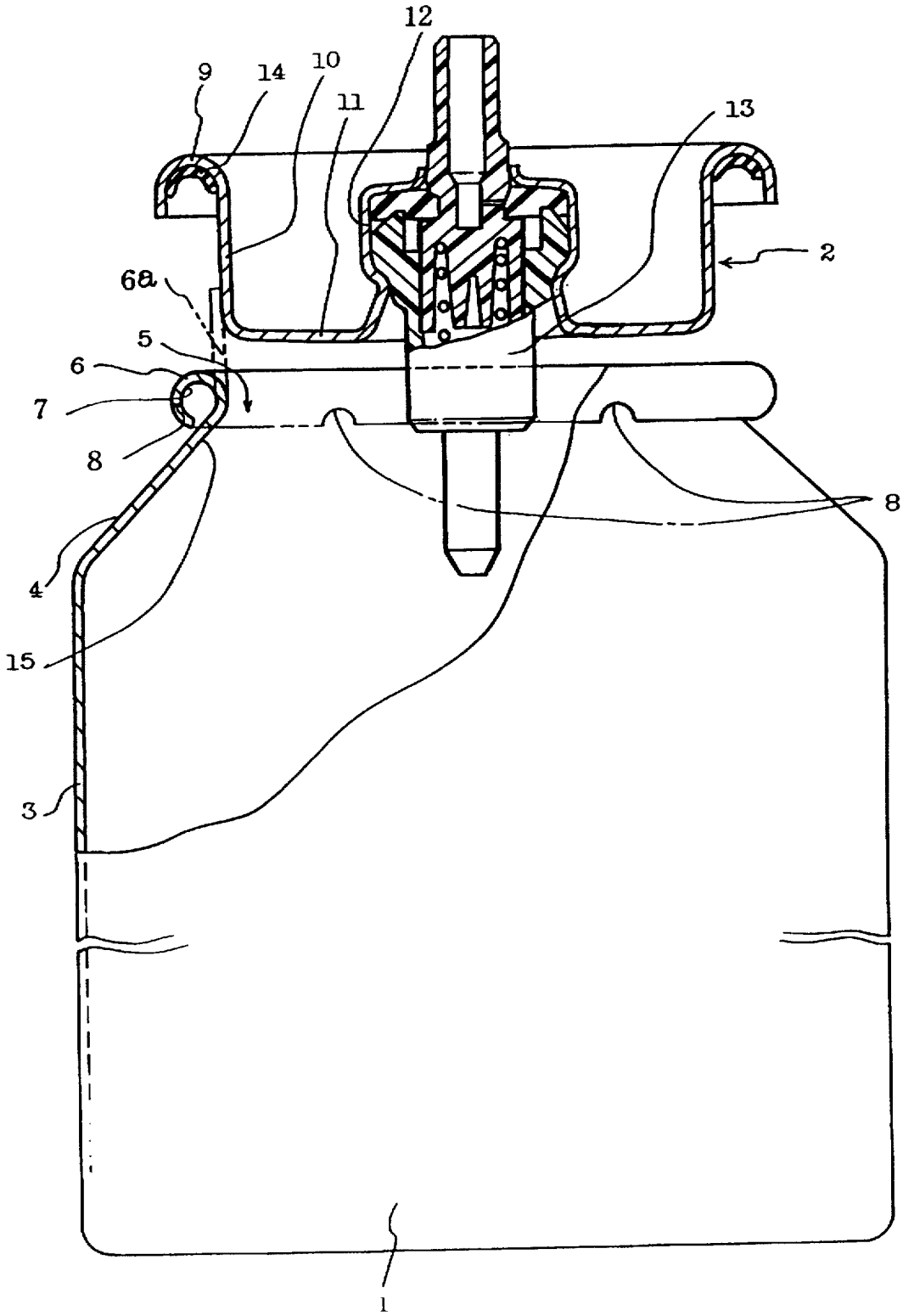
FIG. 2 is a partially omitted sectional view showing the structure of FIG. 1 in a state before assembly.

Referring to FIGS. 1 and 2, reference mark 1 denotes a vessel body of an aerosol container A, and reference mark 2 denotes a mounting cap or a lid member mounted on an upper opening portion of the vessel body 1. The vessel body 1 has a cylindrical trunk portion 3 with a bottom, a shoulder portion 4 extending from the upper end of the trunk portion 3 and a curled portion 6 formed on an upper periphery of the shoulder portion 4 by curling process. In the present embodiment, the inner face 7 of the curled portion 6 is cut so that the thickness of wall is reduced. Further, as clearly shown in the right hand side of FIG. 1 or in FIG. 2. The curled portion 6 is formed with four to six inverse-U-shaped cut-away portions 8 at the lower end of the outer side wall with respect to the center of the vessel. The cut portions 8 are arranged radially at the same intervals in the circumferential direction.

The vessel body 1 can be manufactured, for example, by blanking an aluminum sheet of 0.35 to 0.60 mm in thickness to obtain a disk, impact-forming or drawing-and-ironing the disk to form a trunk portion 3, necking the upper portion of the trunk portion 3 to form the shoulder portion 4 and a cylindrical portion 6*a* in FIG. 2, cutting the outer circumferential surface of the cylindrical portion 6*a* which will be an inner surface of the curl and forming the cut-away portions 8, and forming the curled portion 6 by curling the upper end outward. Then the vessel body 1 shown in FIG. 2 can be obtained. Another metal sheet such as tin-plated steel sheet can be used in stead of the aluminum sheet. A metal sheet covered with a synthetic resin film can also be used.

The above-mentioned mounting cap 2 has an annular capping portion or flange portion 9 with inverse-U-shape in cross section which is to be capped on the curled portion 6, a side wall 10 extending downward from the lower end of the capping portion 9, a bottom 11 extending inward in the radial direction from the lower end of the side wall 10, and a valve-fixing portion 12 rising from the center of the bottom 11. The mounting cap 2 can be manufactured by drawing a metal sheet disk, like the above-mentioned, to form a valve-fixing portion 12, inverse-drawing it to form a side wall 10, trimming the upper end of the side wall 10, and flanging the upper end to form a capping portion 9.

The mounting cap 2 obtained as mentioned above is arranged on the vessel body 1 and is temporally fit with inner circumferential surface of the curled portion 6, after a valve 13 is fixed to the valve-fixing portion 12 and a ring-like gasket 14 is inserted into the capping portion 9.

Then, the mounting cap 2 is securely inserted in the inside of the curled portion 6 after the vessel body 1 is filled with contents. The lower portion of the side wall 10 is locally pressed to expand with four to six crimping claws in the direction of arrow mark A1 so as to abut against the inclining under surface 15 of the curled portion 6 as shown in FIG. 1. Then, the mounting cap 2 is assembled on the vessel body 1.

Figure 3:
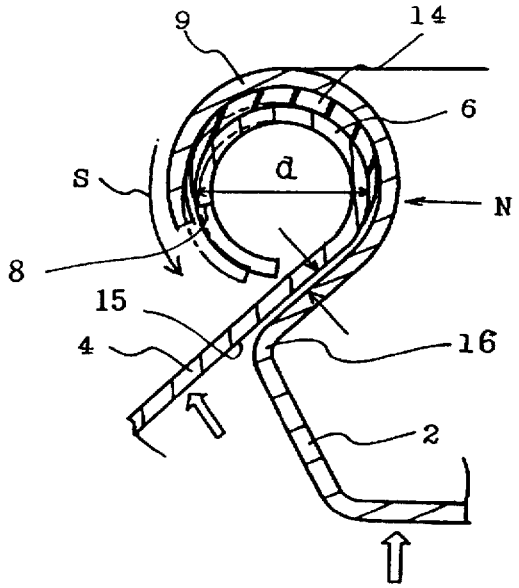
FIG. 3 and FIG. 4 are a partially enlarged sectional view and a plan view, respectively, showing the structure of FIG. 1 in a deformed state.

In the aerosol container A constructed as mentioned above, when the internal pressure rises abnormally, the internal pressure presses the shoulder portion 4 in the perpendicular direction as shown in FIG. 3, and further, the internal pressure presses the mounting cap 2 which is a lid member upward. Therefore, the curled portion 6 tends to be expanded outward as shown by arrow mark N by the internal pressure pressing the shoulder portion 4 and the outward force receiving from the crimped portion 16 of the mounting cap. Beside, the mounting cap 2 receives upward force due to the internal pressure and an reaction force from the under surface 15 of the shoulder portion 4 through the crimped portion 16. Then the mounting cap tends to be compressed inward with respect to the radial direction. Under the situation, the curled portion 6 yields easily since the curled portion 6 is thin as mentioned above and has cut-away portions 8, but the mounting cap 2 does not easily yield. Therefore, as shown in FIG. 3, the curled portion 6 is further curled inward (arrow mark S), and the diameter d of the curl shrinks. Therefore, a gap is generated between the outer surface of the curled portion 6 and the inner surface of the capping portion 9 of the mounting cap 2, or the sealing pressure is reduced. As a result, the internal gas leaks away.

Figure 4:
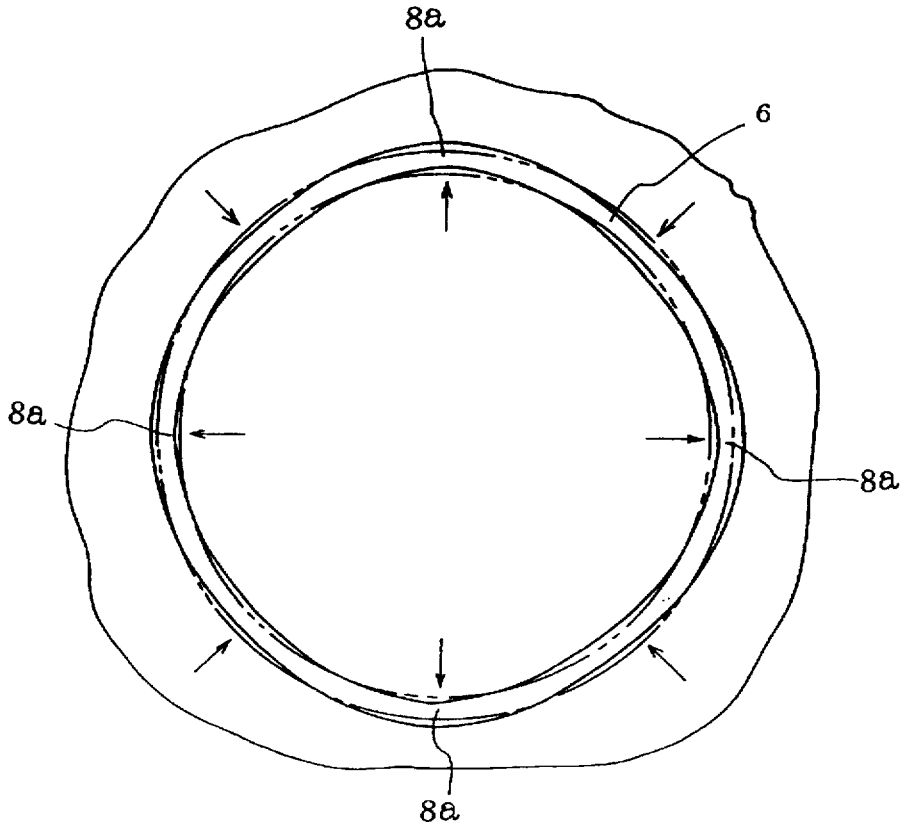

FIG. 4 shows a plan view of deformation of the curled portion 6. That is to say, when the yielding cut-away portions are formed at four positions, the curled portion 6 is deformed into a shape like so called square since the areas 8*a* near the cut-away portions 8 project outward with remaining another area as it is. Such deformation of the curled portion 6 causes gaps between the outer surface of the curled portion 6 and the inner surface of the capping portion 9 of the mounting cap 2, and causes surely the leak of gas. Beside, since the areas 8*a* near the cut-away portions 8 project outward, the crimped portions shown by mark 16 in FIG. 1 are preferably formed at areas apart from the cut-away portions 8.

In such case that the internal pressure in the aerosol container A continues to rise, the elastic deformation of the curled portion 6 and the leak of gas happen intermittently, and the internal gas leaks to keep the internal pressure under a limited level.

In the structure of the present embodiment, since there is difference between the elastic-deformation-resisting strengths for resisting against deformation in the specific direction at the specific part of the curled portion 6 and the mounting cap 2, the mounting cap 2 is prevented to be blown away and safety can be kept. Further, when the internal pressure falls due to fall of the temperature of the outer atmosphere or the like, the elastic deformation of the curled portion 6 returns to the original shape, and the aerosol container A can be continued to use ordinarily.

Figure 5:
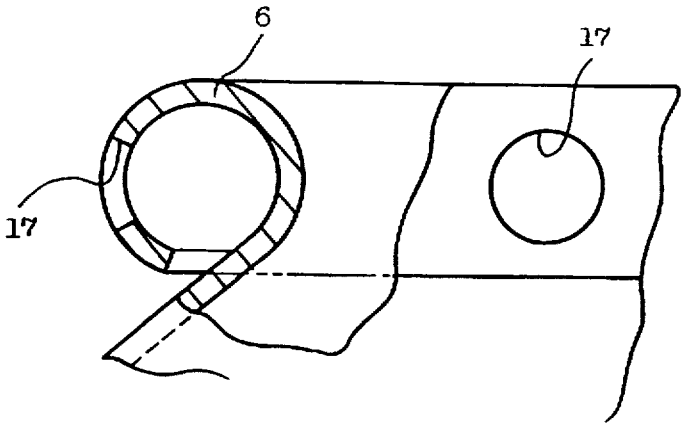
FIG. 5 and FIGS. 6*a* and 6*b* are sectional views showing another embodiments of curled portions relating to the present invention.

FIG. 5 shows an embodiment in which an outer wall of a curled portion 6 is formed with through holes 17 in stead of cut-away portions 8. In this structure, elastic deformation for expanding outward is enlarged so that the gas can leak easily as same as the above-mentioned embodiment.

Figure 6A:
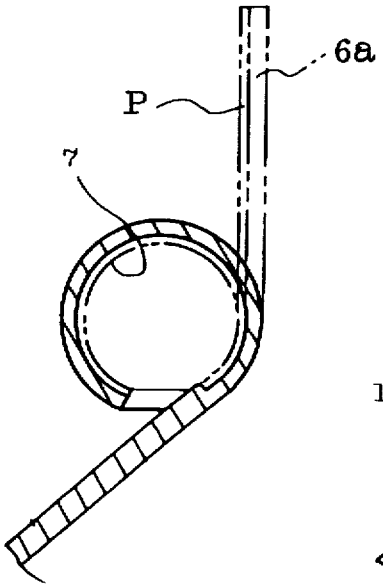
Figure 6B:
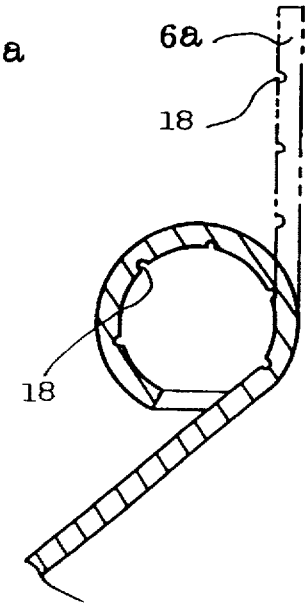

FIG. 6*a* shows an embodiment in which whole of the outer surface of a cylindrical portion 6*a* to be an curled inner surface of a curled portion 6 is cut-away as shown by imaginary lines P, so that the thickness of the curled portion is reduced. Beside, FIG. 6*b* shows an embodiment in which a cylindrical portion 6*a* is formed with annular grooves 18 at the outer surface thereof. When the curled portion 6 is thin or is formed with the grooves 18 as mentioned above, the strength in the curling direction of the curled portion 6 is reduced after the curling-process of the cylindrical portion 6*a*. Therefore, gas-leak function when the internal pressure rises is improved. In addition, the curling-process can be easily performed. Though, the thickness of the vessel body is reduced when the vessel body is formed with drawing-ironing process, the thickness of the cylindrical portion (6*a* in FIG. 2) is enlarged when the shoulder (4 in FIG. 2) is formed by drawing process or necking process to form a neck portion. Therefore, the above-mentioned thinning or grooving process are effective as a pre-treatment process.

Though the process of an impact-forming is the same as the above-mentioned process, the thickness tends to be larger than the draw-ironing process. Therefore, curling process can be easily performed.

Figure 7:
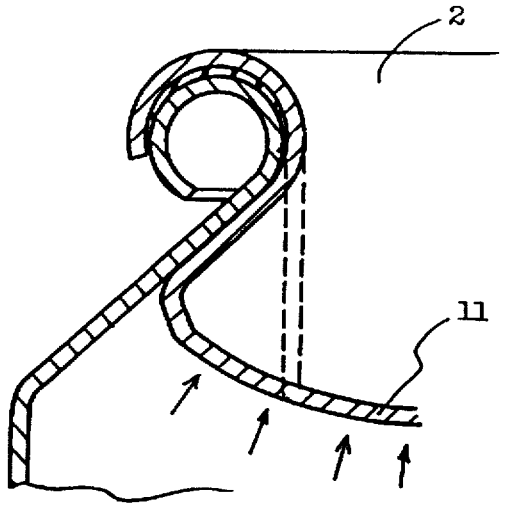
FIG. 7 and FIG. 8 are sectional views showing another embodiments of lid members relating to the present invention.

FIG. 7 shows a mounting cap (lid member) 2 in which a bottom 11 is curved to project toward inside of the vessel. When the bottom 11 curved inward, face-buckling due to the internal pressure cannot easily happen as like the bottom of vessel body. Therefore, the curled portion 6 expands enough outward before blowout of the mounting cap, and gas can easily leak. As a result, the blowout of the mounting cap 2 can be prevented more securely.

Figure 8:
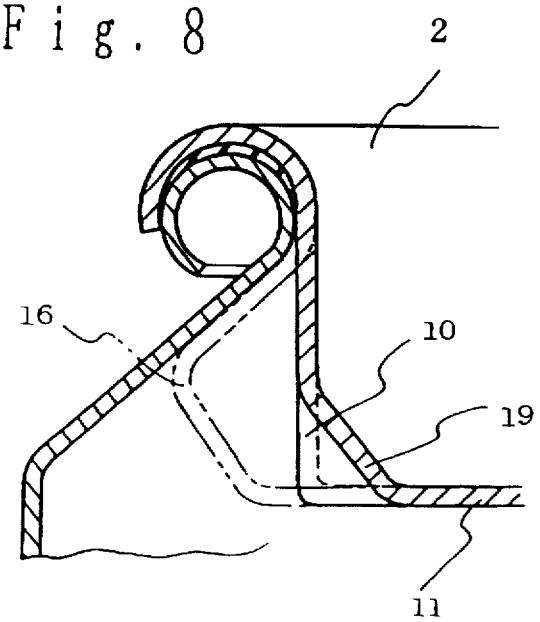

FIG. 8 shows an embodiment of a mounting cap 2 in which reinforcing ribs extending radially are formed from the side wall 10 to the bottom 11. The reinforcing ribs 19 are formed at middle positions between the crimped portions 16 so as not to disturb crimping process. In the embodiment, the mounting cap 2 can also be prevented from being blown away, since plane buckling does not easily happen in the mounting cap. The crimped portions 16 are preferably inserted and engaged deeply so that the crimped portions 16 project outward beyond the center of the curled portion 6. Then the mounting cap 2 is further prevented from being blown away.

Figure 9A:
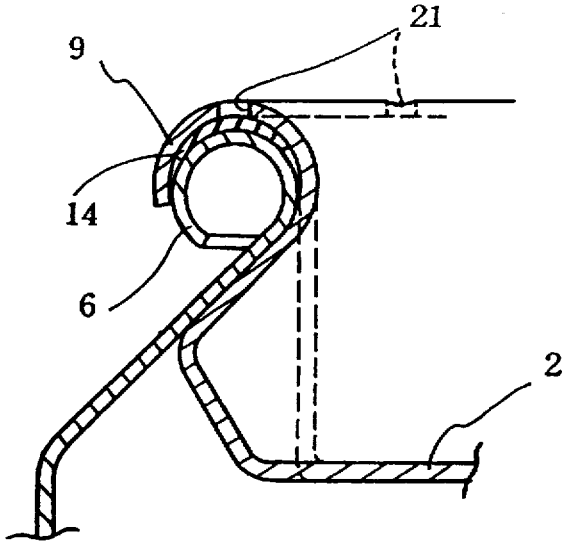
FIGS. 9*a* and 9*b* are sectional views showing further another embodiment of the structure of the present invention and function thereof.
Figure 9B:
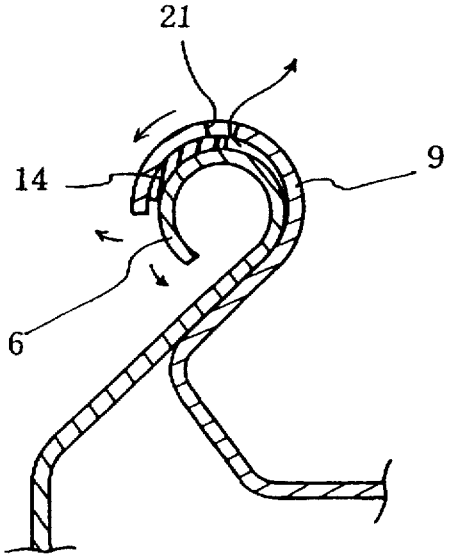

In a structure shown in FIG. 9*a*, the capping portion 9 of the mounting cap 2 is formed with through holes 21 at the upper face thereof. It is preferable to form plural through holes 21 with same intervals in the circumferential direction. In this embodiment, the through holes 21 are closed with a gasket 14 when normal internal pressure is applied. However, when abnormal internal pressure is applied, the gasket 14 is depressed outward and is deformed elastically greatly as shown in FIG. 9*b*. Therefore, the through holes 21 are connected with the inside of the vessel to cause leak of gas. And when the internal pressure falls, the gasket 14 shrinks to the original shape again, and closes the through holes 21 to recover seal-function. Beside, when the internal pressure rises abnormally, the curled portion 6 further curls as mentioned above, and further, the capping portion 9 expands outward as the gasket 14 expanding. Therefore, the gasket 14 can further expand.

Figure 10A:
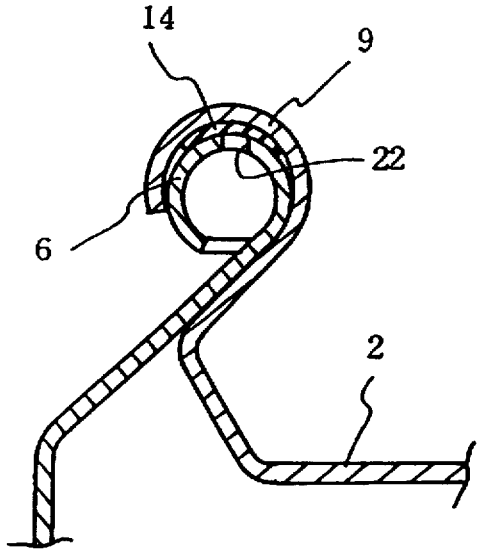
FIGS. 10*a* and 10*b* are sectional views showing further another embodiment of the structure of the present invention and function thereof.
Figure 10B:
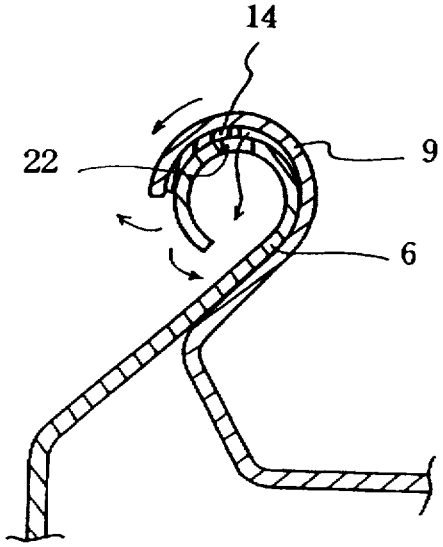

In the embodiment of structure shown in FIG. 10*a*, through holes 22 are formed in the upper wall of the curled portion 6. In this embodiment, as same as the structure of FIGS. 9*a* and 9*b*, the through holes 22 are closed with the gasket 14 under normal internal pressure, and the gasket 14 expands when abnormal internal pressure is applied, and the through holes 22 are connected with the inside (see FIG. 10*b*).

Figure 11:
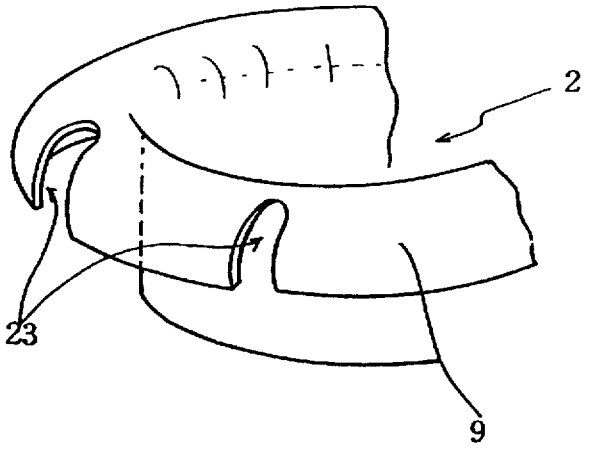
FIG. 11 is a perspective view showing another embodiment of a capping portion relating to the present invention.

The mounting cap 2 shown in FIG. 11 has cut-away portions or notches 23 at plural positions arranged in the circumferential direction at the capping portion 9. The cut-away portion 23 extends from upper side to the periphery end of the capping portion 9. The embodiment performs the same function and effect as the structure of FIG. 9*a*. In addition, the deformation of the capping portion 9 due to the internal pressure is large at the area near the cut-away portion 23, and the deformation is small at remaining area. Therefore, the capping portion 9 will deform like a polygon (see embodiment of curled portion 6 in FIG. 4). Therefore, the gasket 14 expands locally at areas corresponding to the cut-away portion 23, and gas leaks surely.

Figure 12:
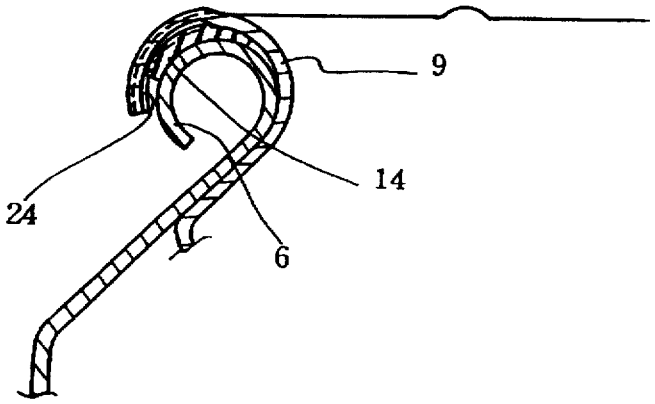
FIG. 12 is a sectional view showing further another embodiment of the structure of the present invention.

The structure of FIG. 12 is formed with embosses 24 in stead of cut-away portions 23 in the embodiment of FIG. 11. The embosses 24 are risen slightly from the upper surface of the capping portion 9 and are arranged radially at plural positions. The embodiment can perform the same function and effect as the embodiment which is provided with cut-away portions 23. In addition, strength is enlarged, since the wall is not cut away, and the wall continues in the circumferential direction.

Figure 13:
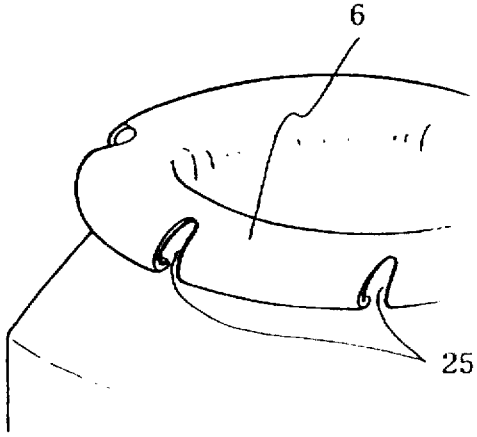
FIG. 13 is a perspective view showing another embodiment of a curled portion relating to the present invention.

The curled portion 6 shown in FIG. 13 is formed with cut-away portions or notches 25 extending from the upper wall to the periphery. That is to say, the cut-away portion 25 is obtained by adding the through hole 22 in the structure of FIG. 10*a* to the cut-away portion 8 in the structure of FIG. 1, and can perform combined their functions and effects together. Further, since the deformation-resisting strength is reduced, the deformation is large when it deforms to a polygon as shown in FIG. 4.

Figure 14:
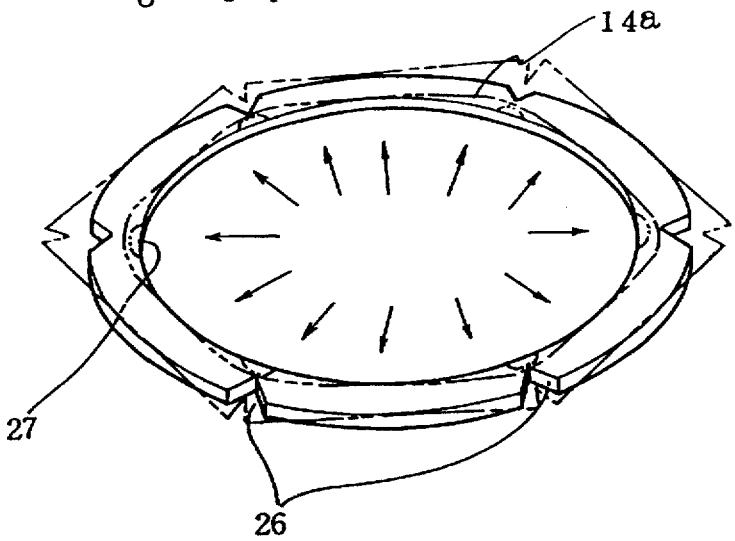
FIG. 14 is a perspective view showing another embodiment of a gasket relating to the present invention.
Figure 15:
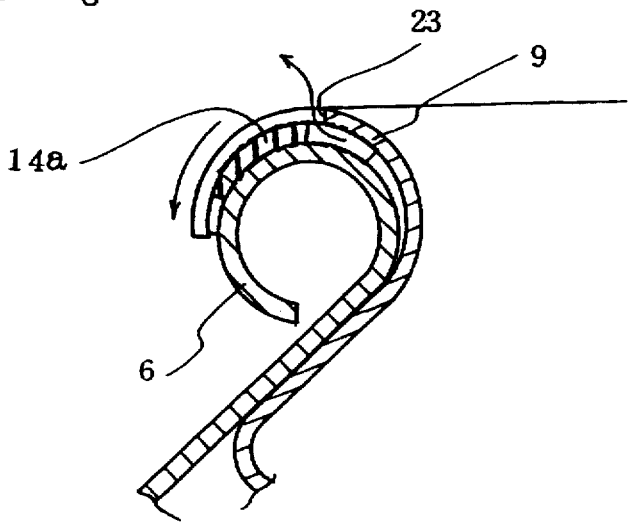
FIG. 15 is a perspective view in part showing another embodiment of a gasket relating to the present invention.

The gasket 14*a* shown in FIG. 14 has plural cut-away portions or notches 26 at periphery thereof. The gasket 14*a* is also interposed between the curled portion 6 and the capping portion 9 as shown by imaginary lines in FIG. 15, when it is used. However, internal pressure is applied in the direction of arrow marks in FIG. 14, the gasket 14*a* is pressed outward as shown by real lines in FIG. 15 and is elastically deformed to expand outward. Further, the gasket 14*a* is deformed into polygonal shape as shown by imaginary lines in FIG. 14. Then, the area of inner periphery corresponding to the cut-away portion 26 is greatly deformed. Therefore, gas tends to leak through the portion, and gas leaks to reduce the internal pressure when the internal pressure rises abnormally. When the gasket 14*a* is combined with the above-mentioned structure having a capping portion with through holes (see FIG. 9*a*), a curled portion with through holes (see FIG. 10*a*), a capping portion with cut-away portions or embosses (see FIGS. 11 and 12), or a curled portion with cut-away portion (see FIG. 13), gas can easily leak through the through hole or the like further.

Figure 16:
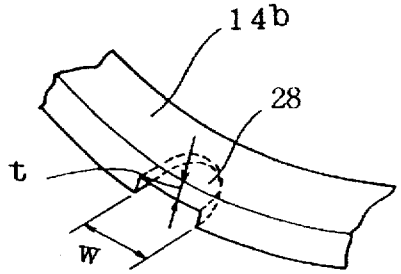
FIG. 16 is a sectional view showing another embodiment of the structure of the present invention.

The gasket 14*b* shown in FIG. 16 has thin portions 28 instead of cut-away portion. The thin portion 28 has the same shape as the cut-away portion. The width W of the thin portion 28 is 2 to 10 mm for example, and preferably 3 to 5 mm like the cut-away portion, and the thickness t of the thin portion is ⅕ to ⅘, preferably ⅖ to ⅗ or the like of the thickness of the gasket. The embodiment can perform substantially the same function and effect as the gasket 14*a* of FIG. 14.

Figure 17:
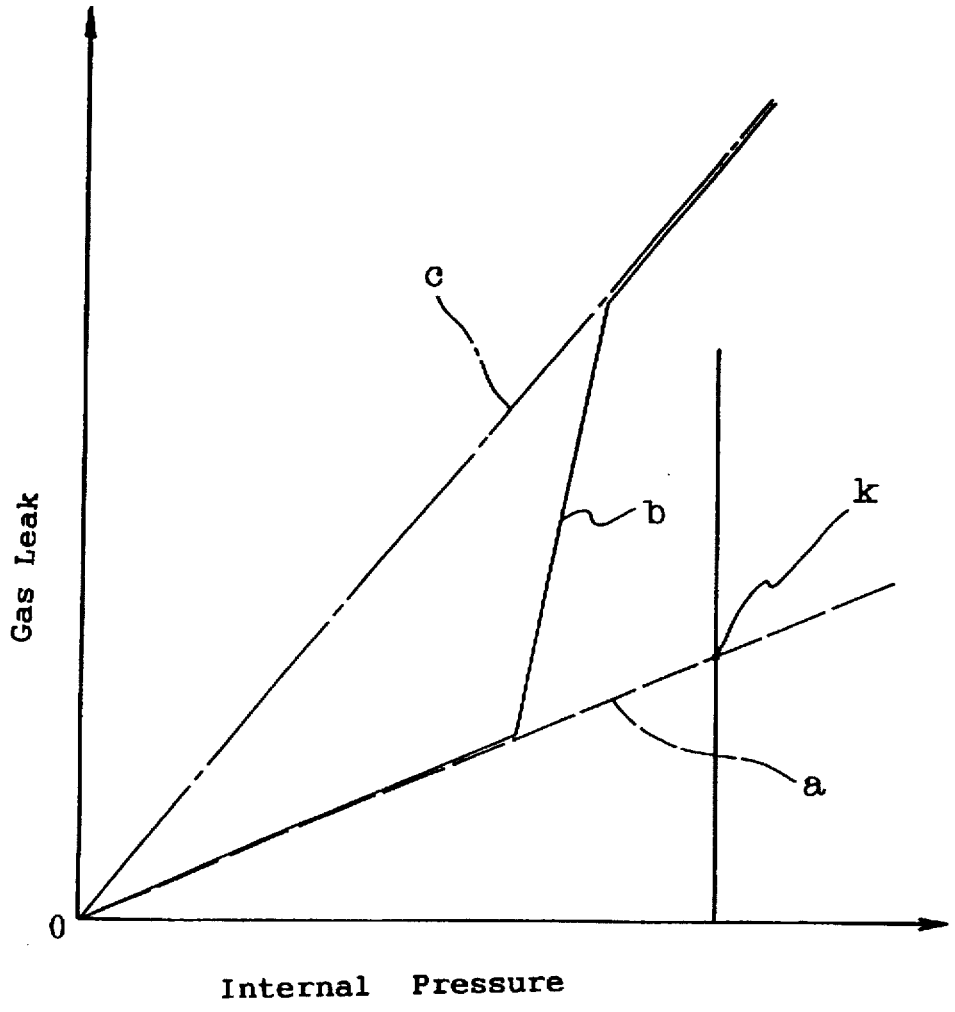
FIG. 17 is a graph showing function of the structure of the present invention in comparison with a prior art structure.

The graph of FIG. 17 shows schematically the relationship between the internal pressure and amount of gas leak (for example volume flow). In a case where airtightness is high, even if the internal pressure rises as shown by a broken line a for example, the amount of leak does not rise greatly. Therefore, if the internal pressure rises rapidly, the vessel breaks or the lid is blown away (see point K). Though the relationship is shown as a direct proportion by a straight line in the graph, the line may be curved actually. In a case where airtightness is low, as shown by a chain line C, gas-leak is large even if the internal pressure rises slightly. Therefore, the rise of internal pressure is low as compared with the high air tightness case. However, there is problem that gas-leak is large at a range of normal internal pressure.

Beside, a real line b shows schematically relationship between the internal pressure and amount of gas-leak for a vessel with the structure for mounting a lid member of the present invention. In this case, amount of gas-leak is the same as the high airtightness case at a range of normal internal pressure. However, once the internal pressure rises abnormally beyond a pre-determined level, amount of gas-leak increases rapidly, since the capping portion, curled portion or the gasket is deformed locally as mentioned above. Therefore, the internal pressure falls to the same level as the low airtightness case or moreover. As a result, in the lid mounting structure of the present invention, both of the high sealing function under the normal internal pressure and the safety under the abnormal internal pressure can be obtained.

In the lid mounting structure of the present invention, when the internal pressure rises, gas leaks locally due to the deformation of the curled portion, the gasket or the capping portion. Therefore, gas leaks through a gap between the lid member and the curled portion to reduce internal pressure before the lid is blown away. As a result, the lid member can be prevented from being blown away, and safety can be kept. Further, after the internal pressure is reduced due to the gas-leak, the sealing function is recovered. Therefore, the vessel can be used again.

We claim:

1. A lid mounting structure for a pressure vessel, the structure comprising:

a body provided with a curled portion curling outward at periphery of an opening;

a lid member fixed on the opening of the body;

said lid member being provided with a ring-like capping portion having an inverse-U shape in cross section so as to be capped around the curled portion, a side wall extending downward from an inner and lower end of the capping portion so as to be received with an inner circumferential face of the curled portion, and a bottom extending inwardly from a lower end of the side wall;

said lid member being fixed to the opening of the body by projecting lower portions of the side wall outward in radial directions to be crimped with under face of the curled portion; and a ring-like gasket interposed between the curled portion and the capping portions, wherein a seal structure constructed with the curled portion, the gasket and the capping portion, is not uniform with respect to circumferential direction such that at least one of the curled portion, the gasket or the capping portion is elastically deformed to cause local leak before the lid member is plastically deformed to be blown away.

2. The structure of claim 1, wherein:

an elastic-deformation-resisting strength for resisting against elastic deformation of the curled portion in a curling direction which provides expansion of inside diameter thereof and which is caused by the internal pressure and the pressing force of the lid member is smaller than an elastic-deformation-resisting strength for resisting against shrinking inward in a radial direction of the side wall of the lid member which is caused by the internal pressure and reactive force of the curled portion;

thereby local leak being caused before the lid member is plastically deformed to be blown away.

3. The structure of claim 2, wherein:

the elastic-deformation-resisting strength of the curled portion is locally weakened by forming plural cut-away portions or holes at outside wall of the curled portion so as to be arranged radially.

4. The structure of claim 2, wherein:

the plural cut-away portions or holes are arranged at middle positions between crimped portions adjacent mutually.

5. The structure of claim 1, wherein:

the thickness of the inner curled side of the curled portion is locally reduced.

6. The structure of claim 1, wherein:

the crimped portions are projected to a position corresponding to the center of curl of the curled portion or to out side beyond the center of the curl.

7. The structure of claim 1, wherein:

the bottom of the lid member is bent toward inside of the vessel.

8. The structure of claim 1, wherein:

the lid member is provided with reinforcing ribs extending from the side wall to the bottom.

9. The structure of claim 1, wherein:

the capping portion of the lid member has a through hole or cut-away portion at an area to be in contact with the gasket tightly, for leaking gas in the vessel as the gasket expanding.

10. The structure of claim 1, wherein:

the curled portion is formed with a through hole or cut-away portion for leaking gas in the vessel as the gasket is elastically expanded at an area to be in contact with the gasket tightly.

11. The structure of claim 1, wherein:

the gasket has a periphery formed with a through hole or a cut-away portion for leaking gas in the vessel as the gasket is elastically expanded.

12. The structure of claim 10 wherein:

the through hole or cut-away portion is formed at plural positions arranged radially.

13. The structure of claim 1, wherein:

the gasket has a thin portion locally with respect to circumferential direction.

14. The structure of claim 13, wherein:

the thin portion is formed at plural positions arranged ragially.

15. The structure of claim 11: the through hole or cut-away portion is formed at plural positions arranged radically.

* * * * *